US011548707B2

(12) United States Patent
Ball

(10) Patent No.: US 11,548,707 B2
(45) Date of Patent: Jan. 10, 2023

(54) CARTON AND BLANK THEREFOR

(71) Applicant: WestRock Packaging Systems, LLC, Atlanta, GA (US)

(72) Inventor: Nathaniel B. Ball, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/291,349

(22) PCT Filed: Nov. 7, 2019

(86) PCT No.: PCT/US2019/060200
§ 371 (c)(1),
(2) Date: May 5, 2021

(87) PCT Pub. No.: WO2020/097287
PCT Pub. Date: May 14, 2020

(65) Prior Publication Data

US 2021/0394984 A1 Dec. 23, 2021

Related U.S. Application Data

(60) Provisional application No. 62/757,437, filed on Nov. 8, 2018.

(51) Int. Cl.
*B65D 71/36* (2006.01)

(52) U.S. Cl.
CPC ..... *B65D 71/36* (2013.01); *B65D 2571/0045* (2013.01); *B65D 2571/0066* (2013.01);
(Continued)

(58) Field of Classification Search
CPC ... B31B 50/86; B31B 50/624; B31B 2105/00; B31B 2120/302; B31B 2241/001; B65D 5/52; B65D 5/54; B65D 71/30; B65D 71/36; B65D 71/38; B65D 2571/00141; B65D 2571/00277; B65D 2571/00462;
(Continued)

(56) References Cited

U.S. PATENT DOCUMENTS 10,279,951 B2 * 5/2019 Walling ..... B65D 5/541
10,577,160 B2 * 3/2020 Zacherle ..... B65D 5/703
(Continued)

FOREIGN PATENT DOCUMENTS

WO 2006099426 A1 9/2006
WO 2006119360 A1 11/2006
WO 2014190267 A1 11/2014

*Primary Examiner* — Bryon P Gehman
(74) *Attorney, Agent, or Firm* — Rohini K. Garg

(57) ABSTRACT

Aspects of the disclosure relate to a package, a carton, and a blank for forming the carton. An aspect of the invention provides a carton comprising a plurality of primary panels defining an interior of the carton. The plurality of panels comprises a first primary panel and a second primary panel hingedly connected to the first primary panel along a first fold line. The carton comprises a plurality of end closure panels including first and second end closure panels hingedly connected respectively to the first and second primary panels. The first end closure panel is hingedly connected to the first primary panel along a second fold line and to the second end closure panel. The second fold line is disposed obliquely to the first fold line.

19 Claims, 7 Drawing Sheets

(52) U.S. Cl.
CPC ..... *B65D 2571/00141* (2013.01); *B65D 2571/00543* (2013.01); *B65D 2571/00574* (2013.01); *B65D 2571/00728* (2013.01)

(58) Field of Classification Search
CPC .. B65D 2571/00524; B65D 2571/0066; B65D 2571/00666; B65D 2571/00728; B65D 2571/0079; B65D 2571/0087
See application file for complete search history.

(56) References Cited

U.S. PATENT DOCUMENTS

| | | | | |
|---|---|---|---|---|
| 10,981,693 | B2 * | 4/2021 | Spivey, Sr. ..... | B65D 77/38 |
| 2019/0144184 | A1 * | 5/2019 | Zacherle ..... | B65D 71/36 229/242 |

* cited by examiner

CARTON AND BLANK THEREFOR

TECHNICAL FIELD

The present invention relates to product packaging, to article carriers or cartons, and to blanks for forming the same. More specifically, but not exclusively, the invention relates to a carton having a dispensing feature for accessing the contents of the carton.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a carton or article carrier having dispensing feature for accessing the contents of the carrier. It is desirable that the articles are retained within the interior of carton when the dispensing feature is deployed.

The present invention seeks to provide an improvement in the field of cartons and carton blanks, typically formed from paperboard or the like.

SUMMARY

A first aspect of the disclosure provides a carton for packaging one or more articles. The carton may comprise a plurality of panels extending at least partially around an interior of the carton. The plurality of panels may comprise a first primary panel and a second primary panel hingedly connected to the first primary panel along a first fold line. The carton may comprise a plurality of end closure panels including first and second end closure panels hingedly connected respectively to the first and second primary panels. The first end closure panel may be hingedly connected to the first primary panel along a second fold line and to the second end closure panel. The second fold line may be disposed obliquely to the first fold line. The carton may comprise an article dispensing feature comprising a tear initiation feature defined in the first primary panel and a removable portion at least partially removably connected to the carton. The removable portion may be defined at least in part by first and second tear lines.

The first tear line may extend from the tear initiation feature across the first fold line into the second primary panel. The second tear line may extend from the tear initiation feature to the second fold line.

A second aspect of the disclosure provides a carton for packaging one or more articles. The carton may comprise a plurality of panels extending at least partially around an interior of the carton. The plurality of panels may comprise a first primary panel and a second primary panel hingedly connected to the first primary panel along a first fold line. The carton may comprise a plurality of end closure panels including first, second and third end closure panels hingedly connected respectively to the first and second primary panels. The first end closure panel may be hingedly connected to the first primary panel along a second fold line and to the second end closure panel. The second fold line may be disposed obliquely to the first fold line. The second end closure panel may be hingedly connected to the second primary panel. The third end closure panel may be hingedly connected to the first primary panel along a third fold line. The third fold line may be disposed obliquely to the second fold line. The carton may comprise an article dispensing feature comprising a tear initiation feature defined in the first primary panel and a removable portion at least partially removably connected to the carton. The removable portion may be defined at least in part by first and second tear lines. The first tear line may extend from the tear initiation feature across the first fold line into the second primary panel. The second tear line may extend from the tear initiation feature to the third fold line.

A third aspect of the disclosure provides a carton for packaging one or more articles. The carton may comprise a plurality of panels extending at least partially around an interior of the carton. The plurality of panels may comprise a first primary panel and a second primary panel hingedly connected to the first primary panel along a first fold line. The carton may comprise a plurality of end closure panels including first and second end closure panels hingedly connected respectively to the first and second primary panels. The first end closure panel may be hingedly connected to the first primary panel along a second fold line and to the second end closure panel. The second fold line may be disposed obliquely to the first fold line. The carton may comprise an article dispensing feature comprising a tear initiation feature defined in the first primary panel and a removable portion at least partially removably connected to the carton. The removable portion may be defined at least in part by first and second tear lines. The first tear line may extend from the tear initiation feature across the first fold line into the second primary panel. The second tear line may extend from the tear initiation feature to a side end edge of the first primary panel.

Optionally, a side end edge of a first primary panel is defined by a fold line hinging an end closure panel to the first primary panel.

Optionally, a second tear line extends from a tear initiation feature to a vertex or intersection between a second fold line and a third fold line, the third fold line hingedly connecting an end closure panel to a first primary panel.

Optionally, a second tear line extends from a tear initiation feature to a second fold line, the second fold line comprising a proximal end and a distal end, the proximal end being disposed in closer proximity to a first fold line than the distal end, and wherein the second tear line extends from a tear initiation feature to the distal end of the second fold line.

Optionally, a carton comprises a plurality of similarly dimensioned and substantially cylindrical articles disposed at least in part in an interior of the carton such that a first primary panel is disposed along ends of the articles, wherein a tear initiation feature is located in registry with a space between at least three adjacent ones of the articles.

Optionally, a carton comprises a plurality of similarly dimensioned and substantially cylindrical articles disposed at least in part in an interior of the carton such that a first primary panel is disposed along ends of the articles, wherein a tear initiation feature is located in registry with the end of one of the articles.

Optionally, a carton comprises a plurality of similarly dimensioned and substantially cylindrical articles disposed at least in part in an interior of the carton such that a first primary panel is disposed along ends of the articles, each of the articles having a diameter, wherein a tear initiation feature is spaced apart from a second fold line by a distance that is no less than the diameter.

Optionally, an opening is defined in at least a first end panel such that first and second fold lines are spaced apart by the opening.

Optionally, a tear initiation feature is spaced apart from a first fold line by a distance that is no less than a diameter of an article being packaged.

Optionally, a plurality of end closure panels includes a third end panel hingedly connected to a first primary panel along a third fold line, and wherein a tear initiation feature is spaced apart from the third fold line by a distance that is no less than the diameter of an article being packaged.

Optionally, a removable portion of an article dispensing feature includes an opening struck from, or defined in, at least one end panel.

A fourth aspect of the disclosure provides a blank for forming a carton. The blank may comprise a plurality of primary panels for defining an interior of the carton. The plurality of panels may comprise a first primary panel and a second primary panel hingedly connected to the first primary panel along a first fold line. The blank may comprise a plurality of end closure panels including first and second end closure panels hingedly connected respectively to the first and second primary panels. The first end closure panel may be hingedly connected to the first primary panel along a second fold line and to the second end closure panel. The second fold line may be disposed obliquely to the first fold line. The blank may comprise an article dispensing feature comprising a tear initiation feature defined in the first primary panel and a removable portion at least partially removably therefrom. The removable portion may be defined at least in part by first and second tear lines. The first tear line may extend from the tear initiation feature across the first fold line into the second primary panel. The second tear line may extend from the tear initiation feature to the second fold line.

A fifth aspect of the disclosure provides a blank for forming a carton. The blank may comprise a plurality of primary panels for defining an interior of the carton. The plurality of panels may comprise a first primary panel and a second primary panel hingedly connected to the first primary panel along a first fold line. The blank may comprise a plurality of end closure panels including first second and third end closure panels hingedly connected respectively to the first and second primary panels. The first end closure panel may be hingedly connected to the first primary panel along a second fold line and to the second end closure panel. The second fold line may be disposed obliquely to the first fold line. The second end closure panel may be hingedly connected to the second primary panel. The third end closure panel may be hingedly connected to the first primary panel along a third fold line. The third fold line may be disposed obliquely to the second fold line. The blank may comprise an article dispensing feature comprising a tear initiation feature defined in the first primary panel and a removable portion at least partially removably therefrom. The removable portion may be defined at least in part by first and second tear lines. The first tear line may extend from the tear initiation feature across the first fold line into the second primary panel. The second tear line may extend from the tear initiation feature to the third fold line.

A sixth aspect of the disclosure provides a blank for forming a carton. The blank may comprise a plurality of primary panels for defining an interior of the carton. The plurality of panels may comprise a first primary panel and a second primary panel hingedly connected to the first primary panel along a first fold line. The blank may comprise a plurality of end closure panels including first and second end closure panels hingedly connected respectively to the first and second primary panels. The first end closure panel may be hingedly connected to the first primary panel along a second fold line and to the second end closure panel. The second fold line may be disposed obliquely to the first fold line. The blank may comprise an article dispensing feature comprising a tear initiation feature defined in the first primary panel and a removable portion at least partially removably therefrom. The removable portion may be defined at least in part by first and second tear lines. The first tear line may extend from the tear initiation feature across the first fold line into the second primary panel. The second tear line may extend from the tear initiation feature to a side end edge of the first primary panel.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of a package, carton and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, cartons and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
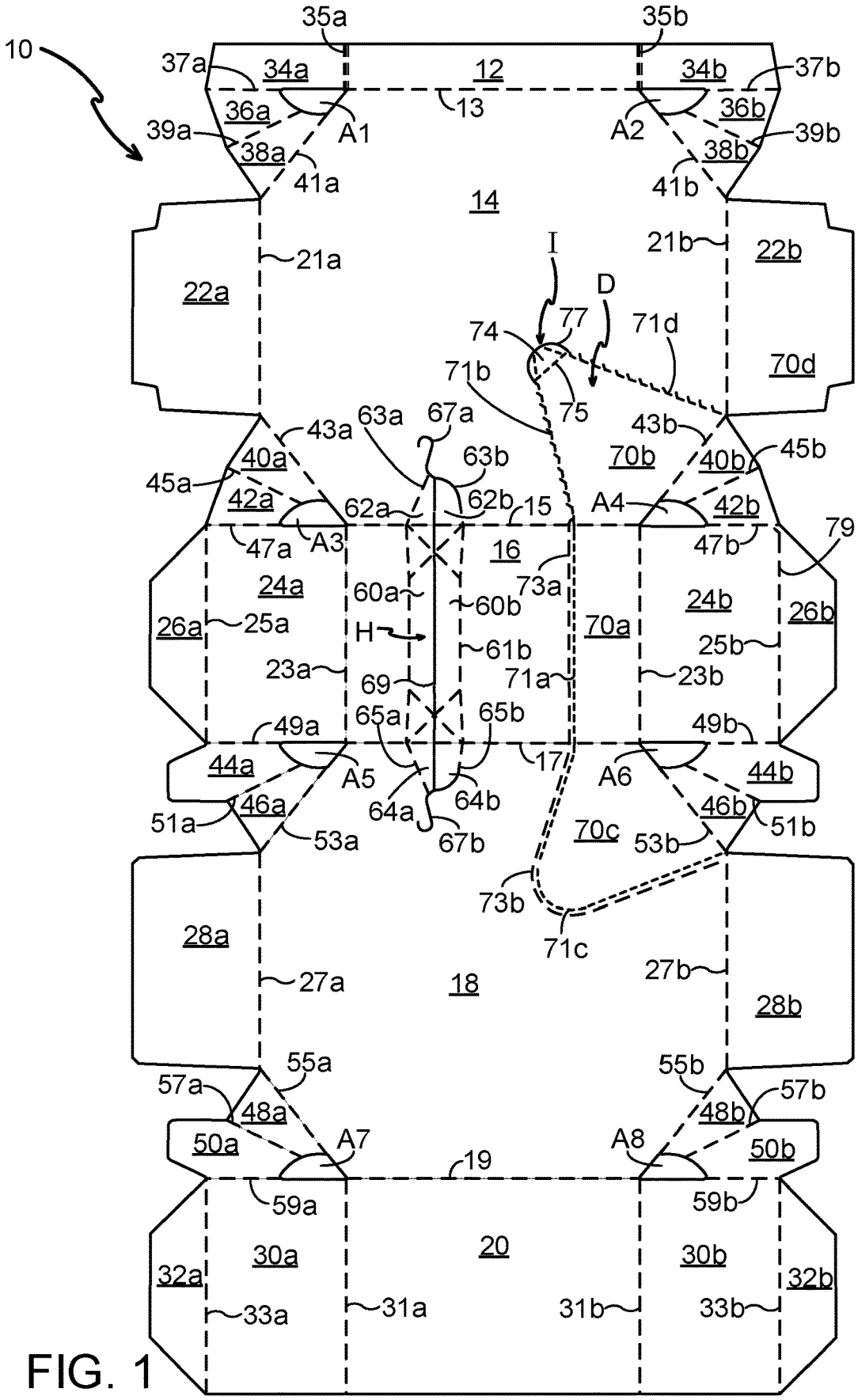
FIG. 1 is a plan view from above of a blank for forming an article carrier according to a first embodiment.
Figure 2:
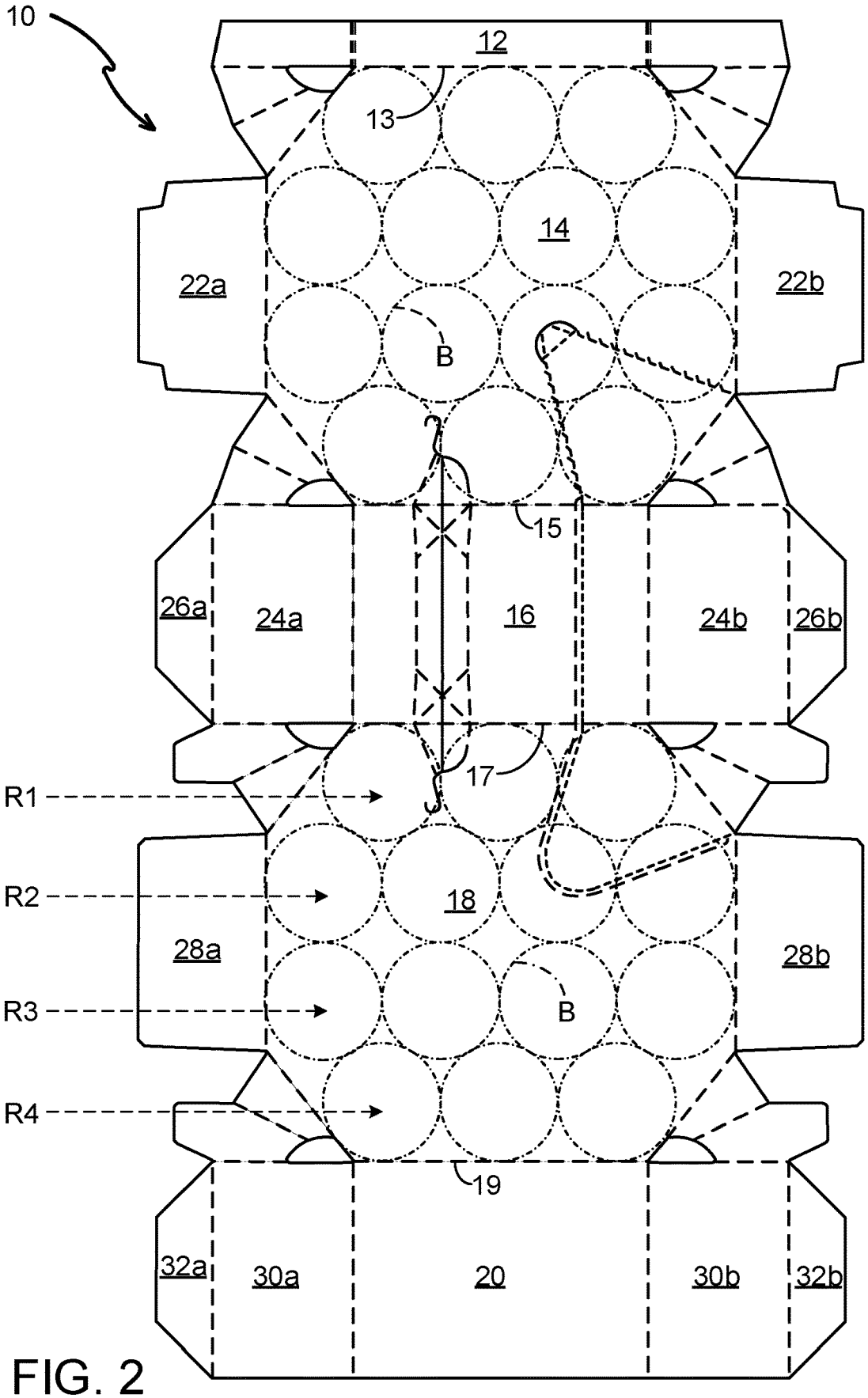
FIG. 2 is a plan view from above of the blank of FIG. 1 showing the arrangement of a plurality of articles with respect to side panels of the blank.
Figure 4:
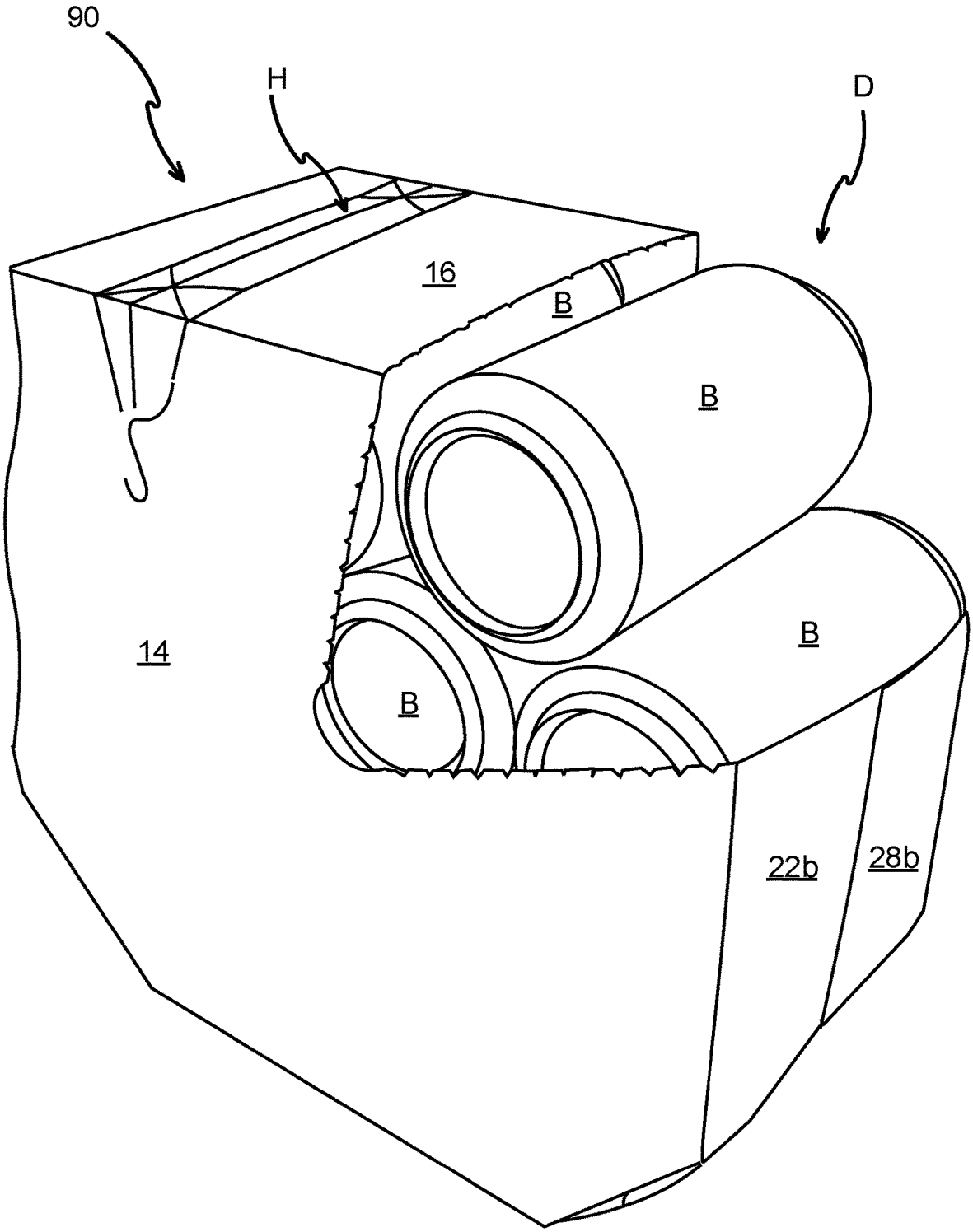
FIG. 4 is a perspective view of the article carrier of FIG. 3 showing a dispensing feature in a deployed condition.

Referring to FIGS. 1 and 2, there is shown plan views of a blank 10, according to an embodiment of the disclosure, capable of forming a package in the form of an article carrier or carton 90, as shown in FIG. 4, for containing and carrying a group of primary products such as, but not limited to, cans, hereinafter referred to as articles B.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

In the embodiment illustrated in FIGS. 1 and 2, the blank 10 is configured to form a carton or carrier 90 for packaging an exemplary arrangement of exemplary articles B. In the illustrated embodiment the arrangement comprises four rows R1, R2, R3, R4. The outermost (upper and lower) rows R1, R4 each comprise three articles, the inner rows R2, R3 each comprise four articles, best shown in FIG. 2. The centres (tubular axes) of the articles in the outer rows R1, R4 are offset with respect to the centres (tubular axes) of the articles in the adjacent inner row R2, R3. In this way an article in an outer row R1, R4 may be nested between a pair of articles in the adjacent inner row R2, R3, that is to say located in a void between said pair of articles.

The centre (tubular axes) of an article in one of the inner rows R2, R3 may be substantially aligned, so as to be in vertical registry in normal dispensing use, with the centre (tubular axes) of an article in the other one of the inner rows R2, R3.

The centre (tubular axes) of an article in one of the outer rows R1, R4 may be substantially aligned with the centre (tubular axes) of an article in the other one of the outer rows R1, R4. The centres of said articles define a notional line the notional line is disposed tangentially to each of a pair of articles in each of the inner rows R2, R3. Each of the aforesaid articles in the outer rows R1, R4 may be in touching contact with each of a pair of articles in the adjacent inner row R2, R3. Each article may be in touching contact with at least one adjacent article.

The articles B are cans, the illustrated example comprises 12 US fl. oz. (355 ml) beverage cans, the cans may be formed from a suitable material such as, but not limited to, Aluminium. Alternatively, the blank 10 can be configured to form a carrier for packaging other types, number and size of articles B and/or for packaging articles B in a different arrangement or configuration for example, but not limited to, the articles B may be bottles, cups, pouches or pots.

Turning to FIG. 1, there is illustrated a blank 10 for forming an article carrier or carton 90 (see FIGS. 3 and 4) according to a first embodiment. The blank 10 comprises a plurality of main or primary panels 12, 14, 16, 18, 20 for forming a tubular structure. The plurality of main panels 12, 14, 16, 18, 20 comprises a securing flap 12, a first side panel 14, a top panel 16, a second side panel 18, and a base panel 20. The plurality of main panels 12, 14, 16, 18, 20 may be hingedly connected to each other, one to the next, in a linear series by a respective one of a plurality of hinged connections in the form of fold lines 13, 15, 17, 19.

The panels of the blank 10 are described with reference to a dispensing feature D which in use is provided in part in a first panel 16 forming a top wall or panel of the carton 90 and which is provided in part in a second and third, adjacently disposed, panels 14, 18 forming side walls or panels of the carton 90, see FIGS. 3 and 4. The carton 90 may also comprise a handle structure H, the handle structure H may be provided at least in part in the first panel 16. The first panel 16, when the handle structure is in use, forms a top wall of the carton 90, however when the carton 90 is being loaded with articles B the first panel 16 may form a side wall of the carton 90.

The first side panel 14 and the second side panel 18 are octagonal in shape. The blank 10 comprises a plurality of major corner or bevel panels 24*a*, 24*b*, 30*a*, 30*b* which partially close ends of the tubular structure defined by plurality of primary panels 12, 14, 16, 18, 20.

The blank 10 comprises a first major corner panel 24*a* hingedly connected to a first end of the top panel 16 by a hinged connection in the form of a fold line 23*a*. The blank 10 comprises a second major corner panel 24*b*, also referred to herein as a sloping panel 24*b*, hingedly connected to a second end of the top panel 16 by a hinged connection in the form of a fold line 23*b*.

The blank 10 comprises a third major corner panel 30*a* hingedly connected to a first end of the base panel 20 by a hinged connection in the form of a fold line 31*a*. The blank 10 comprises a fourth major corner panel 30*b* hingedly connected to a second end of the base panel 20 by a hinged connection in the form of a fold line 31*b*.

The blank 10 comprises end closure structures for completing closure of the open ends of the tubular structure.

A first end closure structure comprises; a first side end closure panel 22*a* hingedly connected to a first end of the first side panel 14 by a hinged connection in the form of a fold line 21*a*, a third side end closure panel 28*a* hingedly connected to a first end of the second side panel 18 by a hinged connection in the form of a fold line 27*a*, a first top end closure panel 26*a* hingedly connected to the first major corner panel 24*a* by a hinged connection in the form of a fold line 25*a*, and a first bottom end closure panel 32*a* hingedly connected to the third major corner panel 30*a* by a hinged connection in the form of a fold line 33*a*.

A second end closure structure comprises; a second side end closure panel 22*b* hingedly connected to a second end of the first side panel 14 by a hinged connection in the form of a fold line 21*b*, a fourth side end closure panel 28*b* hingedly connected to a second end of the second side panel 18 by a hinged connection in the form of a fold line 27*b*, a second top end closure panel 26*b* hingedly connected to the second major corner panel 24*b* by a hinged connection in the form of a fold line 25*b*, and a second bottom end closure panel 32*b* hingedly connected to the fourth major corner panel 30*b* by a hinged connection in the form of a fold line 33*b*.

The second top end closure panel 26*b* and the second major corner panel 24*b* (sloping panel 24*b*) together form an upper end closure flap 24*b*/26*b*. The sloping panel 24*b* is inclined so as to be disposed obliquely with respect to the top panel 16 when the carton 90 is oriented at rest upon the base panel 20.

The first top end closure panel 26*a* and the first major corner panel 24*a* also form a second upper end closure flap 24*a*/26*a*. The first major corner panel 24*a* is inclined so as to be disposed obliquely with respect to the top panel 16 when the carton 90 is oriented at rest upon the base panel 20.

The first bottom end closure panel 32*a* and the third major corner panel 30*a* together form a lower end closure flap 30*a*/32*a*. The third major corner panel 30*a* is inclined so as to be disposed obliquely with respect to the base panel 20 when the carton 90 is oriented at rest upon the base panel 20. The second bottom end closure panel 32*b* and the fourth major corner panel 30*b* together form a second lower end closure flap 30*b*/32*b*. The fourth major corner panel 30*b* is inclined so as to be disposed obliquely with respect to the base panel 20 when the carton 90 is oriented at rest upon the base panel 20.

A first securing tab 34*a* is hingedly connected to a first end of the securing flap 12 by a hinged connection in the form of a fold line 35*a*. A second securing tab 34*b* is hingedly connected to a second end of the securing flap 12 by a hinged connection in the form of a fold line 35*b*.

The first securing tab 34*a* is hingedly connected to the first side panel 14 by a first pair of web panels 36*a*, 38*a*, also referred to herein as minor corner panels (the first pair of web panels 36*a*, 38*a* is hinged to a first bevelled or chamfered corner of the first side panel 14), the first pair of web panels 36*a*, 38*a* underlies the third major corner panel 30*a* in a setup condition. A first web panel 36*a* is hingedly connected to the first securing tab 34*a* by a hinged connection in the form of a fold line 37*a*. A second web panel 38*a* is hingedly connected to the first web panel 36*a* by a hinged connection in the form of a fold line 39*a*. The second web panel 38*a* is hingedly connected to the first side panel 14 by a hinged connection in the form of a fold line 39*a*.

The fold line 37*a* is substantially collinear with the fold line 13.

Each of the first pair of web panels 36*a*, 38*a* is defined in part by a pair of divergently arranged fold lines 37*a*/39*a*, 39*a*/41*a*.

The blank 10 comprises a first aperture A1 struck from the first pair of web panels 36*a*, 38*a* so as to interrupt the fold lines 37*a*, 39*a*, 41*a*. The first aperture A1 is located at a position at which the fold lines 37*a*, 39*a*, 41*a* intersect with each other and with the fold lines 13 and 35*a*.

The second securing tab 34*b* is hingedly connected to the first side panel 14 by a second pair of web panels 36*b*, 38*b*, also referred to herein as minor corner panels (the first pair of web panels 36*a*, 38*a* is hinged to a second bevelled or chamfered corner of the first side panel 14), the second pair of web panels 36*b*, 38*b* underlies the fourth major corner panel 30*b* in a setup condition. A third web panel 36*b* is hingedly connected to the second securing tab 34*b* by a hinged connection in the form of a fold line 37*b*. A fourth web panel 38*b* is hingedly connected to the third web panel 36*b* by a hinged connection in the form of a fold line 39*b*. The fourth web panel 38*b* is hingedly connected to the first side panel 14 by a hinged connection in the form of a fold line 39*b*.

The fold line 37*b* is substantially collinear with the fold line 13.

Each of the second pair of web panels 36*b*, 38*b* is defined in part by a pair of divergently arranged fold lines 37*b*/39*b*, 39*b*/41*b*.

The blank 10 comprises a second aperture A2 struck from the second pair of web panels 36*b*, 38*b* so as to interrupt the fold lines 37*b*, 39*b*, 41*b*. The second aperture A2 is located at a position at which the fold lines 37*b*, 39*b*, 41*b* intersect with each other and with the fold lines 13 and 35*b*.

The first major corner panel 24*a* is hingedly connected to the first side panel 14 by a third pair of web panels 40*a*, 42*a*, also referred to herein as minor corner panels (the third pair of web panels 40*a*, 42*a* is hinged to a third bevelled or chamfered corner of the first side panel 14), the third pair of web panels 40*a*, 42*a* underlies the first major corner panel 24*a* in a setup condition. A fifth web panel 40*a* is hingedly connected to the first side panel 14 by a hinged connection in the form of a fold line 43*a*. A sixth web panel 42*a* is hingedly connected to the fifth web panel 40*a* by a hinged connection in the form of a fold line 45*a*. The sixth web panel 42*a* is hingedly connected to the first major corner panel 24*a* by a hinged connection in the form of a fold line 47*a*.

The fold line 47*a* is substantially collinear with the fold line 15.

Each of the third pair of web panels 40*a*, 42*a* is defined in part by a pair of divergently arranged fold lines 43*a*/45*a*, 45*a*/47*a*.

The blank 10 comprises a third aperture A3 struck from the third pair of web panels 40*a*, 42*a* so as to interrupt the fold lines 43*a*, 45*a*, 47*a*. The third aperture A3 is located at a position at which the fold lines 43*a*, 45*a*, 47*a* intersect with each other and with the fold lines 15 and 23*a*.

The second major corner panel 24*b* is hingedly connected to the first side panel 14 by a fourth pair of web panels 40*b*, 42*b* also referred to herein as minor corner panels (the fourth pair of web panels 40*b*, 42*b* is hinged to a fourth bevelled or chamfered corner of the first side panel 14), the fourth pair of web panels 40*b*, 42*b* underlies the second major corner panel 24*b* in a setup condition. A seventh web panel 40*b* is hingedly connected to the first side panel 14 by a hinged connection in the form of a fold line 43*b*. An eighth web panel 42*b* is hingedly connected to the seventh web panel 40*b* by a hinged connection in the form of a fold line 45*b*. The eighth web panel 42*b* is hingedly connected to the second major corner panel 24*b* by a hinged connection in the form of a fold line 47*b*.

The fold line 47*b* is substantially collinear with the fold line 15.

Each of the fourth pair of web panels 40*b*, 42*b* is defined in part by a pair of divergently arranged fold lines 43*b*/45*b*, 45*b*/47*b*.

The blank 10 comprises a fourth aperture A4 struck from the fourth pair of web panels 40*b*, 42*b* so as to interrupt the fold lines 43*b*, 45*b*, 47*b*. The fourth aperture A4 is located at a position at which the fold lines 43*b*, 45*b*, 47*b* intersect with each other and with the fold lines 15 and 23*b*.

The first major corner panel 24*a* is hingedly connected to the second side panel 18 by a fifth pair of web panels 44*a*, 46*a*, also referred to herein as minor corner panels (the fifth pair of web panels 44*a*, 46*a* is hinged to a first bevelled or chamfered corner of the second side panel 18), the fifth pair of web panels 44*a*, 46*a* underlies the first major corner panel 24*a* in a setup condition. A ninth web panel 44*a* is hingedly connected to the first major corner panel 24*a* by a hinged connection in the form of a fold line 49*a*. A tenth web panel 46*a* is hingedly connected to the ninth web panel 44*a* by a hinged connection in the form of a fold line 51*a*. The tenth web panel 46*a* is hingedly connected to the second side panel 18 by a hinged connection in the form of a fold line 53*a*.

The fold line 49*a* is substantially collinear with the fold line 17.

Each of the fifth pair of web panels 44*a*, 46*a* is defined in part by a pair of divergently arranged fold lines 49*a*/51*a*, 51*a*/53*a*.

The blank 10 comprises a fifth aperture A5 struck from the fifth pair of web panels 44*a*, 46*a* so as to interrupt the fold lines 49*a*, 51*a*, 53*a*. The fifth aperture A5 is located at a position at which the fold lines 49*a*, 51*a*, 53*a* intersect with each other and with the fold lines 17 and 23*a*.

The second major corner panel 24*b* is hingedly connected to the second side panel 18 by a sixth pair of web panels 44*b*, 46*b*, also referred to herein as minor corner panels (the sixth pair of web panels 44*b*, 46*b* is hinged to a second bevelled or chamfered corner of the second side panel 18), the sixth pair of web panels 44*b*, 46*b* underlies the second major corner panel 24*b* in a setup condition. An eleventh web panel 44*b* is hingedly connected to the second major corner panel 24*b* by a hinged connection in the form of a fold line 49*b*. A twelfth web panel 46*b* is hingedly connected to the eleventh web panel 44*b* by a hinged connection in the form of a fold line 51*b*. The twelfth web panel 46*b* is hingedly connected to the second side panel 18 by a hinged connection in the form of a fold line 53*b*.

The fold line 49*b* is substantially collinear with the fold line 17.

Each of the sixth pair of web panels 44*b*, 46*b* is defined in part by a pair of divergently arranged fold lines 49*b*/51*b*, 51*b*/53*b*.

The blank 10 comprises a sixth aperture A6 struck from the sixth pair of web panels 44*b*, 46*b* so as to interrupt the fold lines 49*b*, 51*b*, 53*b*. The sixth aperture A6 is located at a position at which the fold lines 49*b*, 51*b*, 53*b* intersect with each other and with the fold lines 17 and 23*b*.

The third major corner panel 30*a* is hingedly connected to the second side panel 18 by a seventh pair of web panels 48*a*, 50*a*, also referred to herein as minor corner panels (the seventh pair of web panels 48*a*, 50*a* is hinged to a third bevelled or chamfered corner of the second side panel 18), the seventh pair of web panels 48*a*, 50*a* underlies the third major corner panel 30*a* in a setup condition. A thirteenth web panel 48*a* is hingedly connected to the second side panel 18 by a hinged connection in the form of a fold line 55*a*. A fourteenth web panel 50*a* is hingedly connected to the thirteenth web panel 48*a* by a hinged connection in the form of a fold line 57*a*. The fourteenth web panel 50*a* is hingedly connected to the third major corner panel 30*a* by a hinged connection in the form of a fold line 59*a*.

The fold line 59*a* is substantially collinear with the fold line 19.

Each of the seventh pair of web panels 48*a*, 50*a* is defined in part by a pair of divergently arranged fold lines 55*a*/57*a*, 57*a*/59*a*.

The blank 10 comprises a seventh aperture A7 struck from the seventh pair of web panels 48*a*, 50*a* so as to interrupt the fold lines 55*a*, 57*a*, 59*a*. The seventh aperture A7 is located at a position at which the fold lines 55*a*, 57*a*, 59*a* intersect with each other and with the fold lines 19 and 31*a*.

The fourth major corner panel 30*b* is hingedly connected to the second side panel 18 by an eighth pair of web panels 48*b*, 50*b*, also referred to herein as minor corner panels (the eighth pair of web panels 48*b*, 50*b* is hinged to a fourth bevelled or chamfered corner of the second side panel 18), the eighth pair of web panels 48*b*, 50*b* underlies the fourth major corner panel 30*b* in a setup condition. A fifteenth web panel 48*b* is hingedly connected to the second side panel 18 by a hinged connection in the form of a fold line 55*b*. A sixteenth web panel 50*b* is hingedly connected to the fifteenth web panel 48*b* by a hinged connection in the form of a fold line 57*b*. The sixteenth web panel 50*b* is hingedly connected to the fourth major corner panel 30*b* by a hinged connection in the form of a fold line 59*b*.

The fold line 59*b* is substantially collinear with the fold line 19.

Each of the eighth pair of web panels 48*b*, 50*b* is defined in part by a pair of divergently arranged fold lines 55*b*/57*b*, 57*b*/59*b*.

The blank 10 comprises an eighth aperture A8 struck from the eighth pair of web panels 48*b*, 50*b* so as to interrupt the fold lines 55*b*, 57*b*, 59*b*. The eighth aperture A8 is located at a position at which the fold lines 55*b*, 57*b*, 59*b* intersect with each other and with the fold lines 19 and 31*b*.

The blank 10 may comprise a handle structure H. The handle structure H may be provided at least in part in the top panel 16. The handle structure H comprises a handle opening or slot defined in the top panel 16. The handle opening may be defined at least in part by a first handle tab 60*a*. The first handle tab 60*a* is struck from the top panel 16 and is hinged connected thereto by a hinged connection in the form of a fold line 61*a*. The handle opening may be defined at least in part by a second handle tab 60*b*. The second handle tab 60*b* is struck from the top panel 16 and is hinged connected thereto by a hinged connection in the form of a fold line 61*b*. The second handle tab 60*b* is hinged in opposition to the first handle tab 60*a*. The second handle tab 60*b* is separate from, or severable from the first handle tab 60*a* by a common cut line or severance line 69.

A line of separation 69 defines the centre of the slot-type carrying handle H. The line of separation 69 is spaced a longitudinal distance from first and second ends of the top panel 16 (defined by fold lines 23*a*, 23*b* respectively) the line of separation 69 located so as to be disposed off-centre with respect to the first and second ends of the top panel 16. Optionally, in other embodiments, the slot-type carrying handle H may be disposed in an at least substantially central position. The line of separation 69 is positioned such that when the blank 10 is formed into a carton 90 (see FIGS. 3 and 4) the line of separation 69 is located above a gap or void between two adjacent articles B.

The line of separation 69 extends into each of the adjacent first and second side panels 14, 18. In other embodiments, the slot-type carrying handle H may extend into only one of the adjacent first and second side panels 14, 18. The line of separation 69 is optionally a perforate cut line comprising one or more or a series of connecting nick portions. Optionally six connecting nick portions are provided in the top panel 16 along the line of separation 69; one nick portion is provided along the portion of the line of the separation 69 in the first side panel 14; one nick portion is provided along the portion of the line of the line of separation 69 in the second side panel 18.

Spaced either side of the line of separation 69 and within the top panel 16 a pair of fold lines 61*a*, 61*a* define each of the lifting edges of the slot-type carrying handle H. Between fold line 61*a* and line of separation 59 a cushioning flap 60*a* is formed, likewise, between fold line 61*a* and line of separation 69 a cushioning flap 60*b* is formed. The width of the cushioning flaps may be controlled such that when folded beneath the plane of the top panel 16, the cushioning flaps can fold within the gap between the top panel 16 and two adjacently located articles B and at least partially underneath the top panel 16.

At each end of each cushioning flap 60*a*, 60*b* pairs of gussets are formed by crossed fold lines. Optionally the fold lines are disposed at least substantially at 90° relative to one another.

At each end of the slot-type carrying handle H a stress relief mechanism is provided which is tailored and configured to mitigate against stress build up or localised stress points in the carton 90 when the carton 90 is carried by the slot-type carrying handle H, in either direction (i.e. by using edge 61*a* or 61*b*).

The stress relief mechanisms (also referred to as relief cuts) are identical and therefore only one will be described, it being understood that the details provided regarding one end of the slot-type carrying handle H are also true in respect of the other end of the slot-type carrying handle H.

An optional curvilinear crease-cut line 65*b* extends from the intersection of fold lines 61*b* and 17. The curvilinear crease-cut line 65*b* may be formed as a crease along a first linear aspect and then optionally a full-depth cut line on a second curved aspect. The cut line portion of crease-cut line 65*b* may extend beyond the termination of line of separation 58*b* and in close proximity thereto. The cut line portion of crease-cut line 65*b* may terminate with a substantially "J"-shaped or hook-shaped cut line 67*b*. The cut line portion of crease-cut line 65*b* and the line of separation 69 define a first foldable tab 64*b*.

A linear crease line 65*a* extends from the cut line portion of crease-cut line 65*b* the back toward the intersection between fold line 61*a* and fold line 17, to define a second foldable tab 64*a*.

The blank 10 comprises an access device or dispenser D for gaining access to an interior of the carton 90 so as to be able to remove the carton contents.

The dispenser D comprises a removable portion in the form of a detachable panel 70*a*/70*b*/70*c*. A first portion 70*a* of the detachable panel 70*a*/70*b*/70*c* is struck from the top panel 16, a second portion 70*b* of the detachable panel 70*a*/70*b*/70*c* is struck from the first side panel 14, a third portion 70*c* of the detachable panel 70*a*/70*b*/70*c* is struck from the second side panel 18. The second and third portions 70*b*, 70*c* of the detachable panel 70*a*/70*b*/70*c* are hingedly connected to the first portion 70*a* by a portion of fold lines 15, 17 respectively.

The detachable panel 70*a*/70*b*/70*c* includes the second major corner panel 24*b*, the fourth pair of web panels 40*b*, 42*b* and the sixth pair of web panels 44*b*, 46*b*.

The detachable panel 70*a*/70*b*/70*c* is defined in part by a first severance line or tear line 71*a* provided in the top panel 16. The detachable panel 70*a*/70*b*/70*c* is defined in part by a second severance line or tear line 71*b* provided in the first side panel 14, by a third severance line or tear line 71*c* provided in the second side panel 18, by a fourth severance line or tear line 71*d* provided in the first side panel and by a fifth severance line or tear line 79 provided in the second major corner panel 24*b*. The first, second, third, fourth and fifth severance lines 71*a*, 71*b*, 71*c*, 71*d*, 79 are arranged to form a continuous line of severance. The fifth severance line or tear line 71*e* may be coextensive with the fold line 23*b* hinging the second major corner panel 24*b* to the second top end closure flap 26*b*.

The first severance line 71*a* is coupled to the fourth severance line or tear line 71*d* by a tear initiation feature I. The tear initiation feature I may take the form of a foldable tab 74 hingedly connected to the first side panel 14, to the second portion 70*b* of the detachable panel 70*a*/70*b*/70*c* which is struck from the first side panel 14. The tab 74 may be defined in part by a severance line or cut line 77 which couples or connects the first severance line 71*a* to the fourth severance line or tear line 71*d* so as to be contiguous therewith. The cut line 77 may be structured so as to provide less tear resistance (or zero tear resistance) than the first and fourth severance lines 71*a*, 71*d*. In this way the tab 74 may be readily displaced, inwardly, out of the plane of the first side panel 14.

The tab 74 may be positioned such that when the blank 10 is formed into a carton 90 the tab 74 is located adjacent a gap or void between the first side wall 14 and an adjacent article B, an end of the article may be concave so as to provide said void. In other embodiments, the tab 74 is located adjacent a gap or void between two or more articles, for example, but not limited to, the gap may be located between two adjacent articles B in an uppermost inner row R2 and two adjacent articles B in an lowermost inner row R3.

Figure 3:
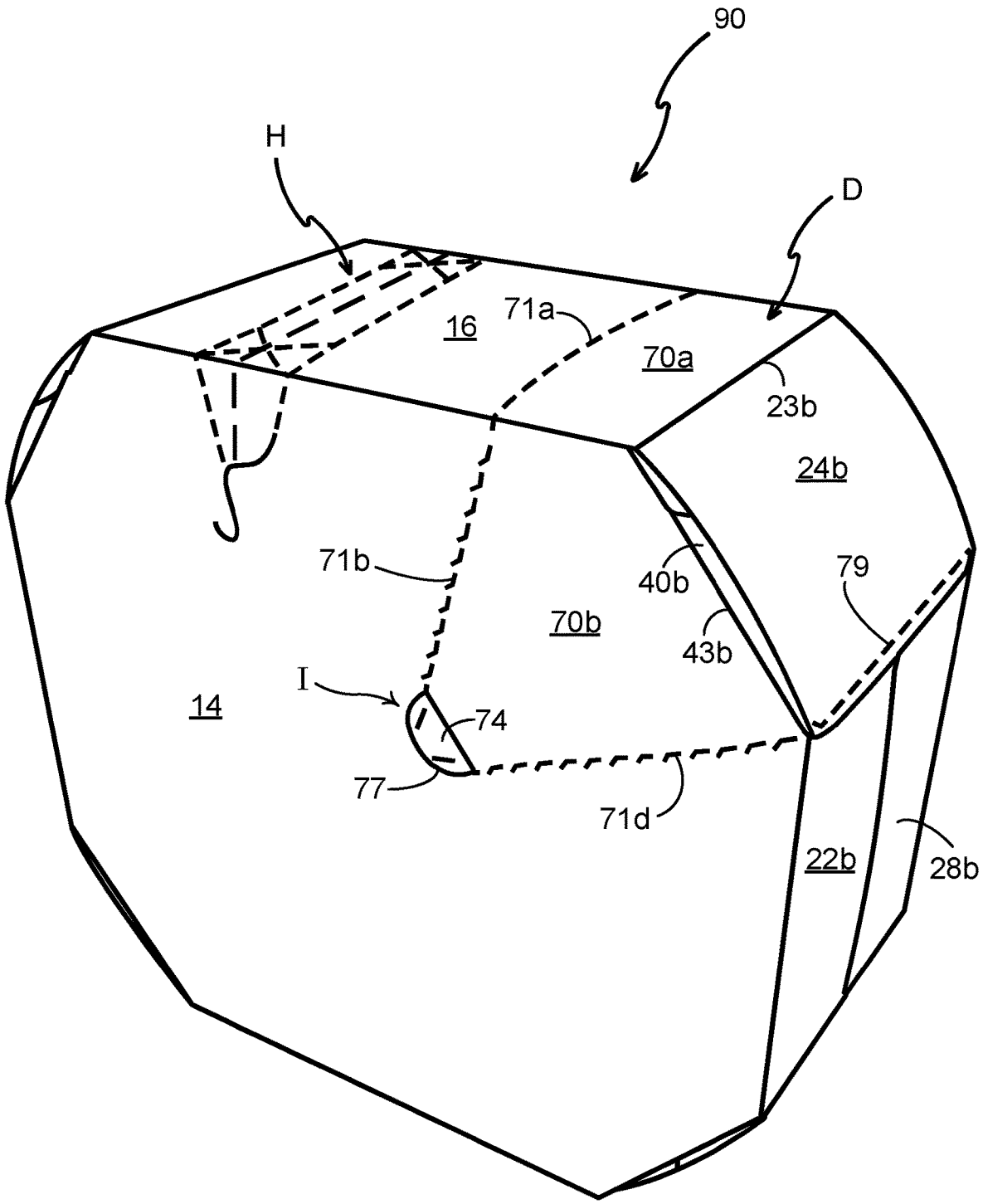
FIG. 3 is a perspective view of an article carrier formed from the blank of FIG. 1.

Turning to the construction of the package as illustrated in FIG. 3, the article carrier 90 can be formed by a series of sequential folding operations. The folding process is not limited to that described below and may be altered according to particular manufacturing requirements.

The blank 10 is folded about fold line 15 such that the first side panel 14 is brought into overlying relationship with the top panel 16, and with part of the second side panel 18, the securing flap is brought into overlying relationship with the second side panel 18.

Glue or other adhesive treatment is applied to the securing flap 12 and to the first and second securing tabs 34*a*, 34*b*. In other embodiments the glue may be applied to corresponding regions of an inner surface of the base panel 20 and the third and fourth major corner panels 30*a*, 30*b*.

The blank 10 is folded about fold line 19 such that the base panel 20 is brought into overlying relationship with the second side panel 18 and into face contacting relationship with the securing flap 12. A portion of each of the third and fourth major corner panels 30*a*, 30*b* is brought into overlying relationship with the second side panel 18, the third and fourth major corner panels 30*a*, 30*b* are brought into face contacting relationship with a respective one of the first and second securing tabs 34*a*, 34*b*.

The base panel 20 is secured to the securing flap 12. The third major corner panel 30*a* is secured to the first securing tab 34*a*. The fourth major corner panel 30*b* is secured to the second securing tab 34*b*.

In this way the blank 10 is thus formed into a flat collapsed tubular structure which can be readily shipped or distributed to a convertor plant, at which the flat collapsed tubular structure may be erected into an open ended tubular structure and loaded with articles.

The flat collapsed tubular structure may be erected to form an open ended tubular structure by unfolding the top panel 16 with respect to the first side panel 14 such that the top panel 16 is disposed substantially perpendicularly with respect to the first side panel 14.

The carton 90, in its open ended tubular form, may be loaded with articles through one or both open ends thereof. It will be appreciated that in some embodiments one of the open ends of the carton 90 may be closed before loading the interior with articles through the remaining open end.

A first end of the tubular structure is closed by folding the first major corner panel 24*a*, about fold line 23*a*, with respect to the top panel 16. The fifth and sixth web panels 40*a*, 42*a* are folded internally into face to face relationship with each other. The ninth and tenth web panels 44*a*, 46*a* are folded internally into face to face relationship with each other.

The third major corner panel 30*a* is folded with respect to the base panel 20, about fold line 31*a*. The first securing tab 34*a* is folded with respect to the securing flap 12, about fold line 35*a*. The thirteenth and fourteenth web panels 48*a*, 50*a* are folded internally into face to face relationship with each other. The first and second web panels 36*a*, 38*a* are folded internally into face to face relationship with each other.

The first top end closure panel 26*a* is folded with respect to the first major corner panel 24*a*, about fold line 25*a*. The first bottom end closure panel 32*a* is folded with respect to the third major corner panel 30*a*, about fold line 33*a*.

The first side end closure flap 22*a* is folded with respect to the first side panel 14, about fold line 21*a*.

Glue or other adhesive treatment is applied to the first side end closure flap 22*a*. In other embodiments the glue may be applied to a corresponding region of an inner surface of the third side end closure flap 28*a*.

The third side end closure flap 28*a* is folded with respect to the second side panel 18, about fold line 27*a*.

The third side end closure flap 28*a* is brought into overlapping relationship with the first side end closure flap 22*a*. The third side end closure flap 28*a* is brought into face to face contacting relationship with the first side end closure flap 22*a*. The third side end closure flap 28*a* is secured to the first side end closure flap 22*a*.

A second end of the tubular structure is closed by folding the second major corner panel 24*b*, about fold line 23*a*, with respect to the top panel 16. The seventh and eighth web panels 40*b*, 42*b* are folded internally into face to face relationship with each other. The eleventh and twelfth web panels 44*b*, 46*b* are folded internally into face to face relationship with each other.

The fourth major corner panel 30*b* is folded with respect to the base panel 20, about fold line 31*b*. The second securing tab 34*b* is folded with respect to the securing flap 12, about fold line 35*b*. The fifteenth and sixteenth web panels 48*b*, 50*b* are folded internally into face to face relationship with each other. The third and fourth web panels 36*b*, 38*b* are folded internally into face to face relationship with each other.

The second top end closure panel 26*b* is folded with respect to the second major corner panel 24*b*, about fold line 25*b*. The second bottom end closure panel 32*b* is folded with respect to the fourth major corner panel 30*b*, about fold line 33*b*.

The second side end closure flap 22*b* is folded with respect to the first side panel 14, about fold line 21*b*.

Glue or other adhesive treatment is applied to the second side end closure flap 22*b*. In other embodiments the glue may be applied to a corresponding region of an inner surface of the fourth side end closure flap 28*b*.

The fourth side end closure flap 28*b* is folded with respect to the second side panel 18, about fold line 27*b*.

The fourth side end closure flap 28*b* is brought into overlapping relationship with the second side end closure flap 22*b*. The fourth side end closure flap 28*b* is brought into face to face contacting relationship with the second side end closure flap 22*b*. The fourth side end closure flap 28*b* is secured to the second side end closure flap 22*b*.

FIG. 3 shows an assembled carton 90. The carton 90 comprises a tubular structure defined by the plurality of main or primary panels 12, 14, 16, 18, 20.

FIG. 4 shows the carton 90 with the dispenser D in a deployed condition, the detachable panel 70*a*/70*b*/70*c* has been removed to provide an opening through which the carton's contents can be removed. When the detachable panel 70*a*/70*b*/70*c* is removed an endmost article B in the first (uppermost) row R1 and in the second row R2 is exposed to view and can be readily withdrawn through the opening created.

The endmost article B in the uppermost row or tier R1 of the group of articles B is presented to the consumer, as shown in FIG. 4, but is retained within the carton 90 by virtue of the nested arrangement between the endmost pair of articles B in the second row or tier R2 (this is the uppermost inner row R2) disposed below the uppermost, first, row R1. The user can remove the endmost article B in the uppermost row R1 in doing so the endmost article B in the second row R2 becomes presented to the consumer and is readily removed. Removal of the endmost article B in the second row R2 creates an instability, the remaining articles B in the second tier R2 tend to roll forward, towards the dispenser opening, the articles come to rest in the voids between adjacent pairs of articles B in the third tier R3.

Similarly any unremoved articles B from the uppermost tier R1 tend to roll forward, towards the dispenser opening, coming to rest in the voids between adjacent pairs of articles B from the second tier R2. This in turn will create space or gap below the top panel 16, between the top panel 16 and the uppermost articles B remaining in the carton 90. This gap allows a user to readily access and or remove the articles B of the first tier R1 and of the second tier R2, as these articles B may not be tightly packed together.

The severance lines 71*b*, 71*d* and cut line 79 defined in the first side panel 14 and the third severance line 71*c* defined in the second side panel 18 are shaped to expose an article adjacent to the endmost article B in the second tier R2 (the uppermost inner row R2). A user may readily grasp the said article B for removal from the carton 90.

The second side end closure flap 22*b* and the fourth side end closure flap 28*b* together form at least a portion of an end wall of the carton 90 extending from the first side panel 14 to the second side panel 18. The composite end wall portion 22*b*/28*b* formed by the second and fourth side end closure flaps 22*b*, 28*b* remains intact after deployment of the dispensing feature D by removing the detachable panel 70*a*/70*b*/70*c*. The composite end wall portion 22*b*/28*b* serves to retain the articles B in at least the second and third tier R2, R3 when the dispensing feature D is deployed.

Figure 5:
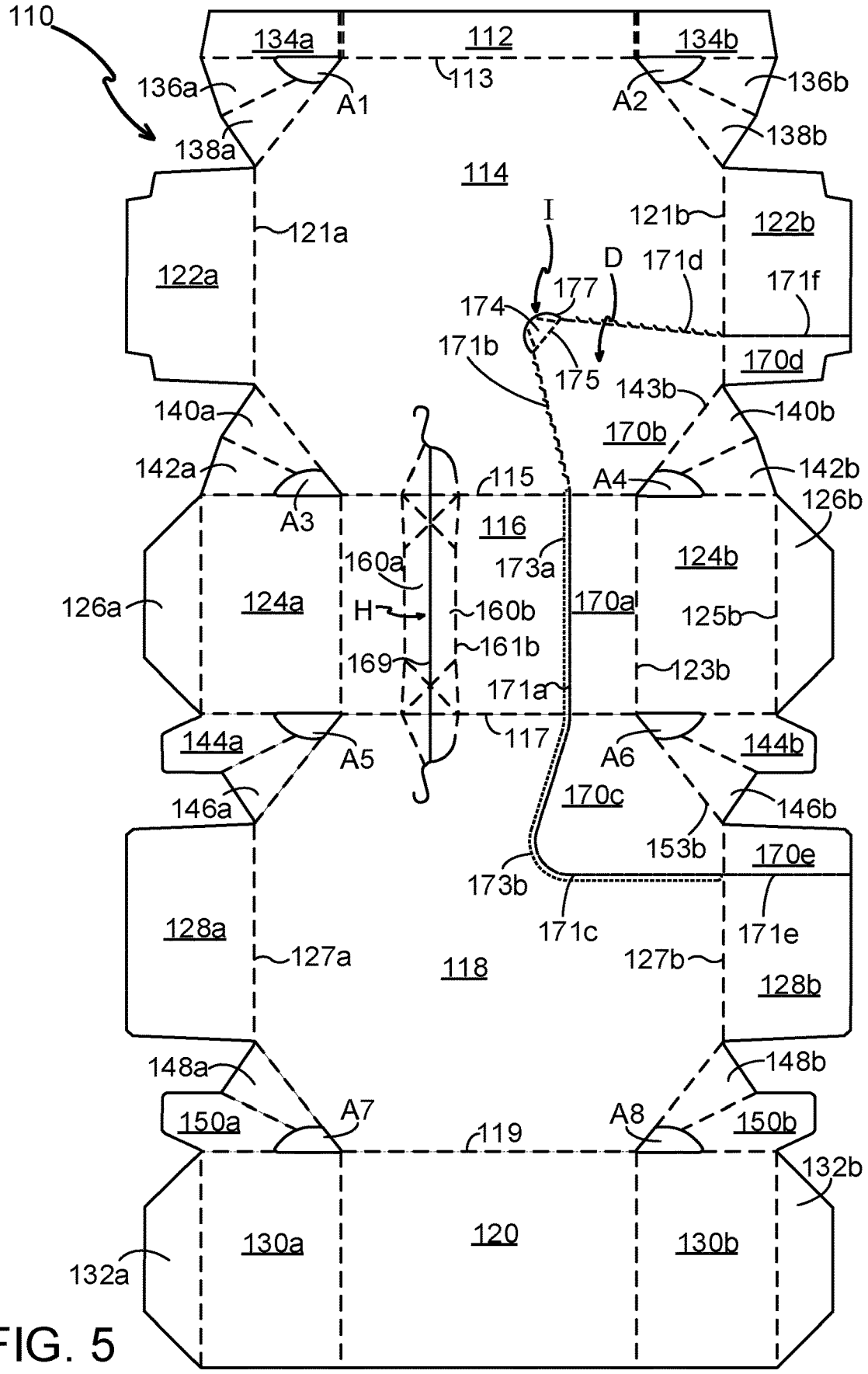
FIG. 5 is a plan view from above of a blank for forming an article carrier according to a second embodiment.
Figure 6:
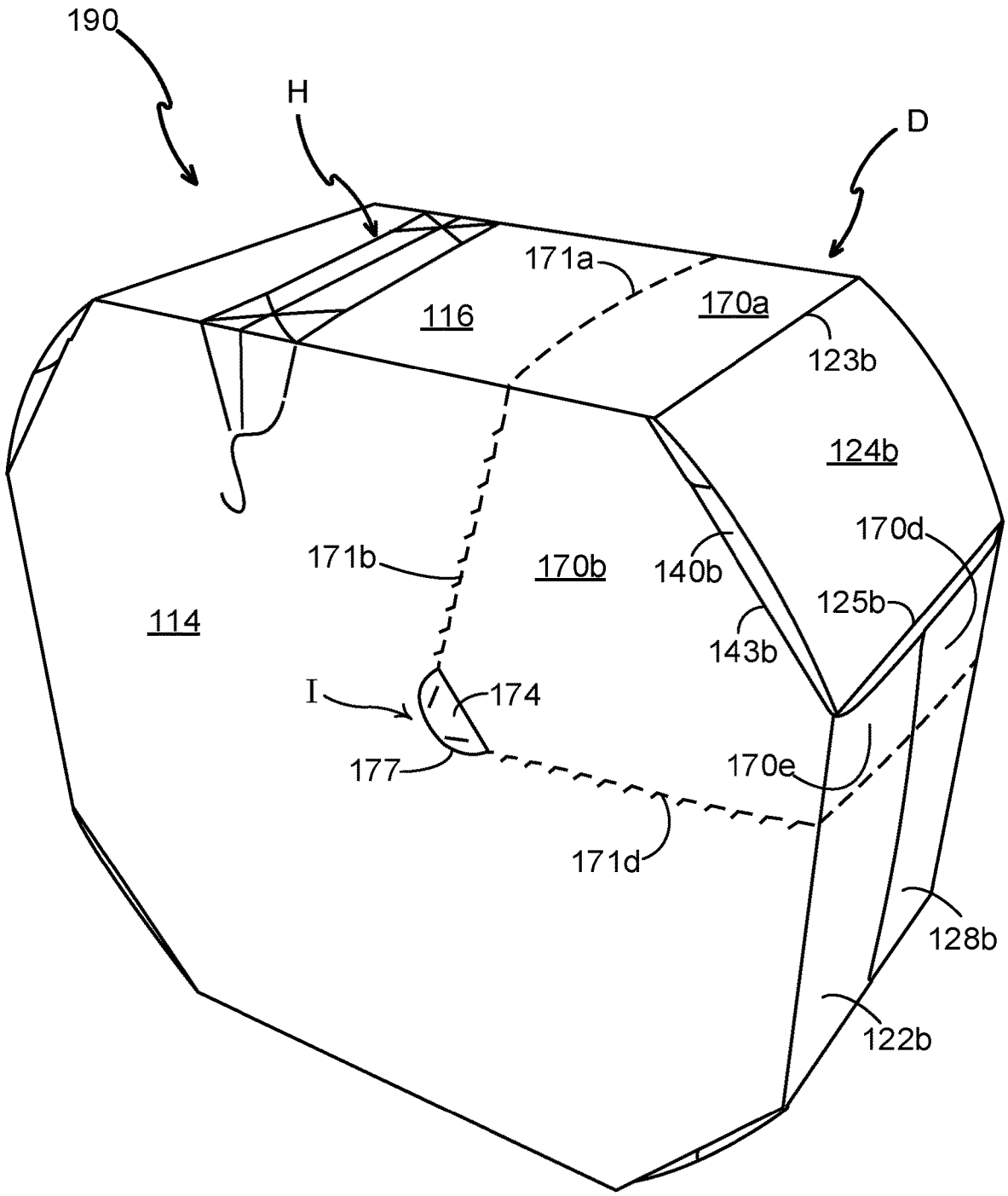
FIG. 6 is a perspective view of an article carrier formed from the blank of FIG. 5.
Figure 7:
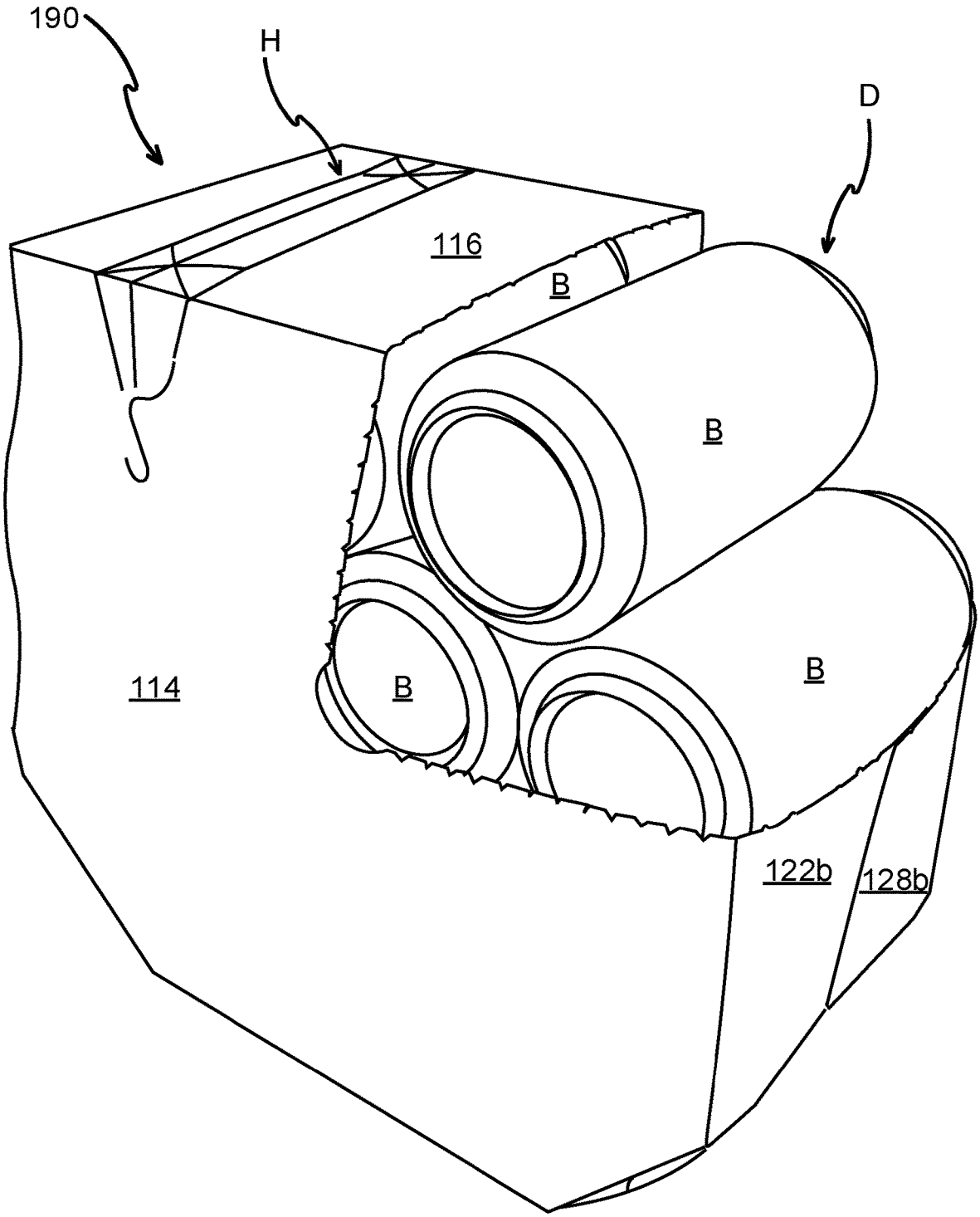
FIG. 7 is a perspective view of the article carrier of FIG. 6 showing a dispensing feature in a deployed condition.

Referring now to FIGS. 5 to 7 there is shown an alternative embodiment of the present disclosure. In the second illustrated embodiment, like numerals have, where possible, been used to denote like parts, albeit with the addition of the prefixes "100" to indicate that these features belong to the second embodiment. The second embodiment shares many common features with the embodiment of FIGS. 1 to 4, therefore only the differences from the embodiment illustrated in FIGS. 1 to 4 will be described in any greater detail.

FIG. 5 shows a blank 110 for forming an article carrier or carton 190 (see FIG. 6) according to a second embodiment. The blank 110 comprises a plurality of primary panels 112, 114, 116, 118, 120 for forming a tubular structure. The plurality of main panels 112, 114, 116, 118, 120 comprises a securing flap 112, a first side panel 114, a top panel 116, a second side panel 118, and a base panel 120. The plurality of main panels 112, 114, 116, 118, 120 may be hingedly connected to each other, one to the next, in a linear series by a respective one of a plurality of hinged connections in the form of fold lines 113, 115, 117, 119.

The blank 110 comprises an access device or dispenser D for gaining access to an interior of the carton 190 so as to be able to remove the carton contents.

The dispenser D comprises a detachable panel 170*a*/170*b*/170*c*/170*d*/170*e*. A first portion 170*a* of the detachable panel 170*a*/170*b*/170*c*/170*d*/170*e* is struck from the top panel 116, a second portion 170*b* of the detachable panel 170*a*/170*b*/170*c*/170*d*/170*e* is struck from the first side panel 114, a third portion 170*c* of the detachable panel 170*a*/170*b*/170*c*/170*d*/170*e* is struck from the second side panel 118, a fourth portion 170*d* of the detachable panel 170*a*/170*b*/170*c*/170*d*/170*e* is struck from the second side end closure flap 122*b* and a fifth portion 170*e* of the detachable panel 170*a*/170*b*/170*c*/170*d*/170*e* is struck from the fourth side end closure flap 128*b*. The second and third portions 170*b*, 170*c* of the detachable panel 170*a*/170*b*/170*c*/170*d*/170*e* are hingedly connected to the first portion 170*a* by a portion of fold lines 115, 117 respectively. The fourth portion 170*d* of the detachable panel 170*a*/170*b*/170*c*/170*d*/170*e* is hingedly connected to the second portion 170*b* by a portion of fold line 121*b*. The fifth portion 170*e* of the detachable panel 170*a*/170*b*/170*c*/170*d*/170*e* is hingedly connected to the third portion 170*c* by a portion of fold line 127*b*.

The detachable panel 170*a*/170*b*/170*c*/170*d*/170*e* includes the second major corner panel 124*b*, the second top end closure flap 126*b*, the fourth pair of web panels 140*b*, 142*b* and the sixth pair of web panels 144*b*, 146*b*.

The detachable panel 170*a*/170*b*/170*c*/170*d*/170*e* is defined in part by a first severance line or tear line 171*a* provided in the top panel 116. The detachable panel 170*a*/170*b*/170*c*/170*d*/170*e* is defined in part by a second severance line or tear line 171*b* provided in the first side panel 114, by a third severance line or tear line 171*c* provided in the second side panel 118, by a fourth severance line or tear line 171*d* provided in the first side panel 114, by a fifth severance line or tear line 171*e* provided in the fourth side end closure flap 128*b* and by a sixth severance line or tear line 171*f* provided in the second side end closure flap 122*b*.

The first severance line 171*a* is coupled to the fourth severance line or tear line 171*d* by a tear initiation feature I. The tear initiation feature I may take the form of a foldable tab 174 hingedly connected to the first side panel 114, to the second portion 170*b* of the detachable panel 170*a*/170*b*/170*c*/170*d*/170*e* which is struck from the first side panel 114. The tab 174 may be defined in part by a severance line or cut line 177 which couples or connects the first severance line 171*a* to the fourth severance line or tear line 171*d* so as to be contiguous therewith.

The first, second, third, fourth, fifth and sixth severance lines 171*a*, 171*b*, 171*c*, 171*d*, 171*e*, 171*f* and cut line 179 are arranged to form a continuous line of severance.

The second side end closure flap 122*b* and the fourth side end closure flap 128*b* together form at least a portion of an end wall of the carton 190 extending from the first side panel 114 to the second side panel 118. An upper region of the composite end wall portion 122*b*/128*b*, formed by the second and fourth side end closure flaps 122*b*, 128*b*, is removed upon deployment of the dispensing feature D when the detachable panel 70*a*/70*b*/70*c* is removed; said upper region is defined by the fourth and fifth portion 170*d*, 170*e* of the detachable panel 170*a*/170*b*/170*c*/170*d*/170*e*. The remaining portion of the composite end wall portion 122*b*/128*b* serves to retain the articles B in at least the second and third tier R2, R3 when the dispensing feature D is deployed.

The present disclosure provides a package comprising a carton or article carrier 90; 190 loaded with one or more articles. The carton 90; 190 comprises a plurality of panels defining an interior of the carton 90; 190. The plurality of panels comprises a first primary panel 14; 114 and a second primary panel 16; 116 hingedly connected to the first primary panel along a first fold line 15; 115.

The carton 90; 190 comprises a plurality of end closure panels including first and second end closure panels 40*b*, 24*b*; 140*b*, 124*b* hingedly connected respectively to the first and second primary panels 14, 16; 114, 116. The first end closure panel 40*b*; 140*b* may be hingedly connected to the first primary panel 14; 114 along a second fold line 43*b*; 143*b* and to the second end closure panel 24*b*; 124*b*, either directly or by an optional third end closure panel 42*b*; 142*b*. The second fold line 43*b*; 143*b* may be disposed obliquely to the first fold line 15; 115.

The carton 90; 190 comprises an article dispensing feature D comprising a tear initiation feature I defined in the first primary panel 14; 114 and a removable portion 70*a*/70*b*/70*c*; 170*a*/170*b*/170*c*/170*d*/170*e* at least partially removably connected to the carton 90; 190. The removable portion 70*a*/70*b*/70*c*; 170*a*/170*b*/170*c*/170*d*/170*e* defined at least in part by first and second tear lines 71*b*/71*a*/71*c*, 71*d*; 171*b*/171*a*/

171c/171e, 171d/171f. The first tear line 71b/71a/71c; 171b/171a/171c/171e extends from the tear initiation feature I across the first fold line 15; 115 into the second primary panel 16; 116.

The second tear line 71d; 171d/171f may extend from the tear initiation feature I to a side end edge of the first primary panel 14; 114. The side end edge of the first primary panel 14; 114 may be defined by a fold line 21b; 121b hinging a further end closure panel 22b; 122b to the first primary panel 14; 114.

The second tear line 71d may extend from the tear initiation feature Ito a vertex or intersection between the second fold line 43b and a third fold line 21b hingedly connecting the further end closure panel 22b to the first primary panel 14.

The second tear line 71d may extend from the tear initiation feature Ito the second fold line 43b.

The second fold line 43b; 143b comprises a first, proximal, end and a second, distal, end, the first, proximal, end being disposed in closer proximity to the first fold line 15; 115 than the second, distal, end.

The second tear line 71d may extend from the tear initiation feature Ito the second, distal, end of the second fold line 43b.

The present disclosure also provides a carton 190 a comprising a plurality of panels extending at least partially around an interior of the carton. The plurality of panels comprising a first primary panel 114 and a second primary panel 116 hingedly connected to the first primary panel 114 along a first fold line 115. The carton 190 comprises plurality of end closure panels including first, second and third end closure panels 140b, 124b, 122b. The first end closure panel 140b may be hingedly connected respectively to the first and second primary panels 114, 116. The first end closure panel 140b may be hingedly connected to the first primary panel 114 along a second fold line 143b and to the second end closure panel 124b, either directly or by an optional fourth end closure panel 142b. The second fold line 143b is disposed obliquely to the first fold line 115. The second end closure panel 124b is hingedly connected to the second primary panel 116. The third end closure panel 122b is hingedly connected to the first primary panel 114 along a third fold line 121b. The third fold line 121b may be disposed obliquely to the second fold line 143b.

The carton 190 comprises an article dispensing feature D comprising a tear initiation feature I defined in the first primary panel 114 and a removable portion 170a/170b/170c/170d/170e at least partially removably connected to the carton 190, the removable portion 170a/170b/170c/170d/170e defined at least in part by first and second tear lines 171b/171a/171c, 171d, the first tear line 171b/171a/171c extending from the tear initiation feature I across the first fold line 115 into the second primary panel 116, the second tear line 171d extending from the tear initiation feature Ito the third fold line 121b, and may extend across the third fold line 121b into the third end closure panel 122b.

The first tear line 71b/71a/71c; 171b/171a/171c may extend across the second primary panel 16; 116 and across a fourth first fold line 17; 117 into a third primary panel 18; 118. The fourth fold line 17; 117 may be disposed substantially parallel to the first fold line 15; 115.

In this way tearing of the first and second tear lines 71b/71a/71c, 71d; 171b/171a/171c/171e, 171d/171f has the effect of separating the first end closure panel 40b; 140b and the second end closure panel 24b; 124b from the respective primary panel to which they are hinged.

The first tear line 171b/171a/171c/171e may extend from the fourth fold line 117 to a fifth fold line 127b hingedly connecting a fourth end closure panel 128b to the third primary panel 118.

A fifth end closure panel 46b; 146b may be hingedly connected to the third primary panel 18; 118 along a sixth fold line 53b; 153b and to the second end closure panel 24b; 124b, either directly or by an optional sixth end closure panel 44b; 144b. The sixth fold line 53b; 153b may be disposed obliquely to the fourth fold line 17; 117. The sixth fold line 53b; 153b may be disposed obliquely to the fifth fold line 27b; 127b.

The carton 90; 190 may comprise first and second top rows R1, R2 of articles B, the first top row R1 is the uppermost row, the second top row R2 is disposed immediately below the first top row R1 so as to be the second row from the top panel 16; 116. The article dispensing feature D defines an access opening in the carton 90; 190 through which articles B of the first and second top rows R1, R2 may exit the carton 90; 190. At least one of the articles B in the second top row R2 may be exposed, at least in part, to view when the article dispensing feature D is fully removed from the carton 90; 190.

The carton 90; 190 may comprise a plurality of similarly dimensioned and substantially cylindrical articles B disposed at least in part in the interior of the carton 90; 190 such that the first primary panel 14; 114 is disposed along ends of the articles B. The tear initiation feature I may be located in registry with a space between at least three adjacent ones of the articles B. The tear initiation feature may be located in registry with the end of one of the articles B.

Each of the articles B has a diameter, wherein the tear initiation feature I may be spaced apart from the second fold line 43b; 143b by a distance that is no less than the diameter.

An opening A4 may be defined in at least the first end panel 40b; 140b such that the first and second fold lines 15, 43b; 115, 143b are spaced apart by the opening A4. The removable portion 70a/70b/70c; 170a/170b/170c/170d/170e may include the opening A4.

The tear initiation feature I may be spaced apart from the first fold line 15; 115 by a distance that is no less than the diameter.

The plurality of end closure panels may include a third end panel 22b; 122b hingedly connected to the first primary panel 14; 114 along a third fold line 21b; 121b. The tear initiation feature I may be spaced apart from the third fold line 21b; 121b by a distance that is no less than the diameter.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles, the carton comprising:

a plurality of panels extending at least partially around an interior of the carton, the plurality of panels comprising:

a first primary panel; and a second primary panel hingedly connected to the first primary panel along a first fold line;

a plurality of end closure panels including a first end closure panel and a second end closure panel hingedly connected respectively to the first and second primary panels, the first end closure panel being hingedly connected to the first primary panel along a second fold line and to the second end closure panel, the second fold line being disposed obliquely to the first fold line; and an article dispensing feature comprising a tear initiation feature defined in the first primary panel and a removable portion at least partially removably connected to the carton, the removable portion defined at least in part by a first tear line and a second tear line, the first tear line extending from the tear initiation feature across the first fold line into the second primary panel, the second tear line extending from the tear initiation feature to at least one of: (i) the second fold line, and (ii) a side end edge of the first primary panel.

2. The carton of claim 1, further comprising a plurality of similarly dimensioned and substantially cylindrical articles disposed at least in part in the interior of the carton such that the first primary panel is disposed along ends of the articles, wherein the tear initiation feature is located in registry with a space between at least three adjacent ones of the articles.

3. The carton of claim 1, further comprising a plurality of similarly dimensioned and substantially cylindrical articles disposed at least in part in the interior of the carton such that the first primary panel is disposed along ends of the articles, wherein the tear initiation feature is located in registry with the end of one of the articles.

4. The carton of claim 1, further comprising a plurality of similarly dimensioned and substantially cylindrical articles disposed at least in part in the interior of the carton such that the first primary panel is disposed along ends of the articles, each of the articles having a diameter, wherein the tear initiation feature is spaced apart from the second fold line by a distance that is no less than the diameter.

5. The carton of claim 4, wherein the tear initiation feature is spaced apart from the first fold line by a distance that is no less than the diameter.

6. The carton of claim 4, wherein the plurality of end closure panels further includes a third end closure panel hingedly connected to the first primary panel along a third fold line, and wherein the tear initiation feature is spaced apart from the third fold line by a distance that is no less than the diameter.

7. The carton of claim 1, wherein an opening is defined in at least the first end closure panel such that the first and second fold lines are spaced apart by the opening.

8. The carton of claim 7, wherein the removable portion includes the opening.

9. The carton of claim 1, wherein the side end edge of the first primary panel is defined by a fold line hinging a further end closure panel to the first primary panel.

10. The carton of claim 1, wherein the second tear line extends from the tear initiation feature to a vertex or intersection between the second fold line and a fourth fold line hingedly connecting a further end closure panel to the first primary panel.

11. The carton of claim 1, wherein the second tear line extends from the tear initiation feature to the second fold line, the second fold line comprising a proximal end and a distal end, the proximal end being disposed in closer proximity to the first fold line than the distal end, and wherein the second tear line extends from the tear initiation feature to the distal end of the second fold line.

12. A carton for packaging one or more articles, the carton comprising:

a plurality of panels extending at least partially around an interior of the carton, the plurality of panels comprising:

a first primary panel; and a second primary panel hingedly connected to the first primary panel along a first fold line;

a plurality of end closure panels including a first end closure panel and a second end closure panel hingedly connected respectively to the first and second primary panels, and a third end closure panel;

the first end closure panel being hingedly connected to the first primary panel along a second fold line and to the second end closure panel, the second fold line being disposed obliquely to the first fold line;

the second end closure panel being hingedly connected to the second primary panel;

the third end closure panel being hingedly connected to the first primary panel along a third fold line, the third fold line being disposed obliquely to the second fold line; and an article dispensing feature comprising a tear initiation feature defined in the first primary panel and a removable portion at least partially removably connected to the carton, the removable portion being defined at least in part by a first tear line and a second tear line, the first tear line extending from the tear initiation feature across the first fold line into the second primary panel, the second tear line extending from the tear initiation feature to the third fold line.

13. A blank for forming a carton, the blank comprising:

a plurality of primary panels for defining an interior of the carton, the plurality of panels comprising:

a first primary panel; and a second primary panel hingedly connected to the first primary panel along a first fold line;

a plurality of end closure panels including a first end closure panel and a second end closure panel hingedly connected respectively to the first and second primary panels, the first end closure panel being hingedly connected to the first primary panel along a second fold line and to the second end closure panel, the second fold line being disposed obliquely to the first fold line; and an article dispensing feature comprising a tear initiation feature defined in the first primary panel and a removable portion at least partially removable, the removable portion defined at least in part by a first tear line and a second tear line, the first tear line extending from the tear initiation feature across the first fold line into the second primary panel, the second tear line extending from the tear initiation feature to at least one of: (i) the second fold line, and (ii) a side end edge of the first primary panel.

14. The blank for forming a carton according to claim 13, the blank further comprising:

a third end closure panel hingedly connected to the first primary panel along a third fold line, the third fold line being disposed obliquely to the second fold line; and the second tear line extending from the tear initiation feature to the third fold line.

15. The blank for forming a carton according to claim 13, wherein an opening is defined in at least the first end closure panel such that the first and second fold lines are spaced apart by the opening.

16. The blank for forming a carton according to claim 15, wherein the removable portion includes the opening.

17. The blank for forming a carton according to claim 13, wherein the side end edge of the first primary panel is defined by a fold line hinging a further end closure panel to the first primary panel.

18. The blank for forming a carton according to claim 13, wherein the second tear line extends from the tear initiation feature to a vertex or intersection between the second fold line and a fourth fold line hingedly connecting a further end closure panel to the first primary panel.

19. The blank for forming a carton according to claim 13, wherein the second tear line extends from the tear initiation feature to the second fold line, the second fold line comprising a proximal end and a distal end, the proximal end being disposed in closer proximity to the first fold line than the distal end, and wherein the second tear line extends from the tear initiation feature to the distal end of the second fold line.

* * * * *